United States Patent [19]

Uralsky et al.

[11] 4,005,596

[45] Feb. 1, 1977

[54] APPARATUS FOR HYDRAULIC PRESSING OF METALS

[76] Inventors: Viktor Ivanovich Uralsky, Pervomaiskaya ulitsa, 82, kv. 71; Vadim Leonidovich Kolmagorov, ulitsa Lenina, 101, kv. 6, both of Sverdlovsk, U.S.S.R.

[22] Filed: Apr. 7, 1975

[21] Appl. No.: 565,456

[52] U.S. Cl. ..... 72/257; 72/270; 72/271; 72/426; 72/60

[51] Int. Cl.[2] ..... B21C 33/00; B21C 35/00

[58] Field of Search ..... 72/60, 253, 257, 263, 72/270, 271, 426, 427, DIG. 31

[56] References Cited

UNITED STATES PATENTS

| | | | |
|---|---|---|---|
| 3,364,719 | 1/1968 | Asari | 72/255 |
| 3,563,075 | 2/1971 | Beresnev et al. | 72/60 |
| 3,740,985 | 6/1973 | Fuchs, Jr. | 72/60 |
| 3,771,221 | 11/1973 | Bachmann | 72/258 |
| 3,871,201 | 3/1975 | Hayashi | 72/257 |

FOREIGN PATENTS OR APPLICATIONS

| | | | |
|---|---|---|---|
| 5,849 | 1967 | Japan | 72/60 |
| 22,566 | 1971 | Japan | 72/253 |
| 15,178 | 1969 | Japan | 72/253 |
| 1,221,879 | 2/1971 | United Kingdom | 72/264 |
| 782,598 | 9/1957 | United Kingdom | 72/257 |

*Primary Examiner*—C.W. Lanham
*Assistant Examiner*—D. M. Gurley

[57] ABSTRACT

An apparatus for hydraulic pressing of metals comprising a receiver of finished articles, made in the form of a framework of two tubes interconnected at the ends by arms. The framework is turned by a separate drive in a horizontal plane, whereby each tube is set to a position axially aligned with a hole in the die wherefrom a pressed article is released into the pipe. As a result, stop-pages for removal of finished articles are not required, and, hence, productivity of the apparatus is improved.

3 Claims, 3 Drawing Figures

APPARATUS FOR HYDRAULIC PRESSING OF METALS

The present invention relates to metal pressure shaping equipment, and, more particularly, to machines used for hydraulic pressing of metals.

The invention can be used in the metal working industry for the shaping of various rods, wire and pipes.

The present invention can most advantageously be used for manufacture of such articles in cases when they must be fabricated from difficult-to-form materials or when a comparatively high accuracy in dimensions and shape is required.

Known in the art is an apparatus for the hydraulic pressing of metals, comprising a container wherein there are a vertical and a horizontal chamber communicating with each other, one of these being filled with hydraulic fluid and accommodating a plunger, the other being provided with an inlet hole furnished with a lock, located adjacent a loader for loading part blanks into said chamber, and aligned axially with an outlet hole accommodating a die and located in proximity to a receiver for receiving finished articles.

The apparatus is designed to operate as part of a vertical press whereon it is installed. The container is made of two sections; a horizontal container and a vertical container fastened to the top side surface of the horizontal container. Each container is provided with a cylindrical chamber. The chambers communicate through a passage in the wall of the horizontal container portion which is rigidly fixed to the press table. A plunger mounted in the vertical section of the container is rigidly fixed to the press yoke. A part blank is placed in the horizontal chamber so that a preworked end of the blank closes the hole in the die installed in the outlet hole of the horizontal chamber.

The receiver of the known apparatus used for receiving the finished articles is essentially a tube permanently installed adjacent the horizontal chamber outlet hole and axially aligned with the chamber. During the pressing process, the tube receiving the pressed articles in thrust against the die with one end and retains the die in the hole of the horizontal chamber, while the other end can be sealed with a plug and a sealing means as required. Prior to the pressing process, the container chambers are filled with fluid. When the yoke and, hence, the plunger moves downward, a pressure built up inside the container chambers forces the blank out through the hole in the die. An article released from the die is placed into the tube wherein it is located until the pressing process is completed. To extract the article out of the tube, it is removed manually or is driven out by the article which follows.

In the case of back pressure (pressing materials of comparatively low plasticity), the space of the tube is connected to a source of hydraulic pressure and is sealed tightly. During the pressing process, the pressure in the tube is maintained constant. On completion of the pressing process, the tube is unsealed and the article is removed manually.

The known apparatus for hydraulic pressing has a number of disadvantages, among which is permanent attachment of the article receiving tube. To remove the article from the tube, a stoppage is necessary so that the efficiency of the apparatus drops.

Another disadvantage of said apparatus is that the article released from the die freely passes into the hole in the horizontal chamber at the section following the die. This is detrimental to the accuracy in shape and size as well as to the rectilinear form of the article.

It is an object of the present invention to provide an apparatus for hydraulic pressing of metals, the construction of which contributes to an improved productivity of the apparatus and facilitates maintenance thereof.

With these and other objects in view, hydraulic pressing apparatus is herein disclosed, wherein the container is provided with communicating vertical and horizontal chambers, one of these being filled with hydraulic fluid and accommodating a plunger, the other being provided with an inlet hole furnished with a lock, located beside a loader for loading workpiece blanks into said chamber, and aligned axially with an outlet hole accommodating a die and located in proximity to a receiver for receiving finished articles, whereby the receiver for receiving the articles is made, according to the invention, in the form of a framework of two tubes placed parallel to each other and linked with arms at the ends, with said arms rigidly interconnected by a shaft constituting the axis of symmetry of said framework and geared to a separate drive which turns the framework in a vertical plane for axial alignment of each tube in succession with the outlet hole in the horizontal chamber of a container and for discharging the finished articles into said chamber during the pressing process.

The pressing machine incorporating the apparatus of the present invention permits operation without stoppages for removal of articles because removal is accomplished simultaneously with release of the following article into the other tube, after the framework is turned. As a consequence, a higher productivity of the apparatus is achieved.

It is preferred that a ring is installed in the container horizontal chamber outlet hole at the section following the die to which the article is moved, said ring having a hole shaped in the same manner as the article to permit additional pressing of the article and to seal the outlet hole at the section between the die and the end of the tube for receiving the finished articles.

Said ring permits pressing of the articles at a varying reduction ratio depending on the desired accuracy in size and shape of the profile of the articles. At the same time, the article is trued when it is fed through the ring. In addition, extra pressing effected by means of the ring brings about a longitudinal stress upon compression of the material of the article which is essential for pressing of materials of comparatively low plasticity. Thus, the use of the ring improves the technological capabilities of the apparatus and eliminates the need for auxiliary equipment for trueing the articles.

In one of the embodiments of the present invention, the receiver used to receive the finished articles is provided with a device for driving the articles out of the tube, comprising a rod axially aligned with the tube when set at a maximum distance from the container, said rod being coupled to a separate drive effecting reciprocal motion of the rod.

The driving device serves for mechanical extraction of the articles from the tube, and, thereby, improves the productivity of the pressing apparatus.

In another embodiment of the invention, the finished article receiver is connected to a source of hydraulic pressure which is intended to produce a back pressure during the pressing process and is connected to the space of the respective tube, with an actuating cylinder arranged coaxially with the container horizontal chamber and tube, and with a cover installed at the end of the cylinder rod for sealing the tube and for fixing said tube against the outlet hole in the horizontal chamber.

The apparatus of this invention permits reduction of the time required to prepare the apparatus for work, and thereby, contributes to improved productivity of the apparatus.

It is expedient that the tubes for receiving the finished articles are movably mounted in the arms along the axis due to the action of a spring seated on each tube and bearing at one end thereof against an annular projection on the tube surface, while the other end bears against the arm and returns the tube to the initial position on completion of the pressing process and on retraction of the rod of the actuating cylinder.

As a consequence, maintenance of the apparatus is simplified and the time required for auxiliary operations is reduced.

Thus, the apparatus for hydraulic pressing of metals of the present invention improves the productivity of the pressing machine and the performance thereof.

The invention will now be described in greater detail with reference to a preferred embodiment thereof taken in conjunction with the accompanying drawings, wherein:

FIG. 1 a sectional view of an apparatus for hydraulic pressing of metal articles, according to the invention, taken along the axis of the horizontal chambers;

Figure 1:
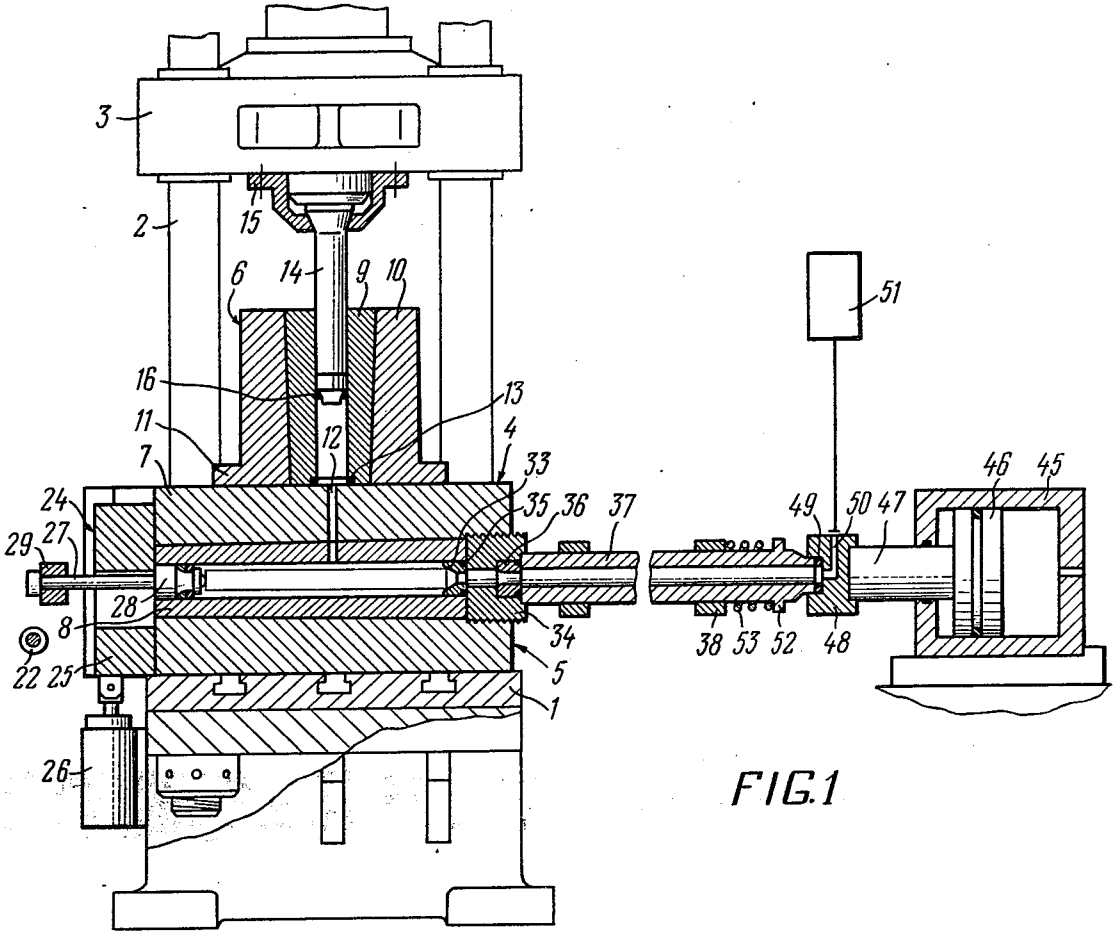

Referring now to FIG. 1, the apparatus for hydraulic pressing of metals, comprises a table 1, and a movable yoke 3 installed thereupon and seated on posts 2. The apparatus incorporates a container 4 composed of two sections 5 and 6. The lower section 5 (according to the drawing) of the container 4 is essentially a solid body 7 wherein a horizontal cylindrical hole is provided. The body 7 is square shaped in cross section and is attached to the table 1 of the press. A bushing 8 press-fitted into the hole in the body 7 is somewhat shorter than the hole in the body 7. A vertical tee-shaped groove is made in the body 7 at the left-hand end face (according to the drawing). The section of the hole in the body 7 not filled by the bushing 8 is threaded. A top section 6 (according to the drawing) of the container 4 incorporates a bushing 9 arranged vertically and press-fitted into a cylindrical case 10 terminating in a flange 11 serving to attach the case to the body 7. The internal spaces of the bushings 8 and 9 communicate through a passage 12 formed in the side of the bushing 8 and in the body 7. The joint between the sections 5 and 6 of the container 4 is sealed by means of a sealing ring 13 fitted into a groove at the end surface of the bushing 9, adjacent to the body 7. The bushing 9 accommodates a plunger 14, the top part thereof (according to the drawing) being attached to the press yoke 3 by means of a flange 15. The plunger carries a sealing ring 16.

Figure 2:
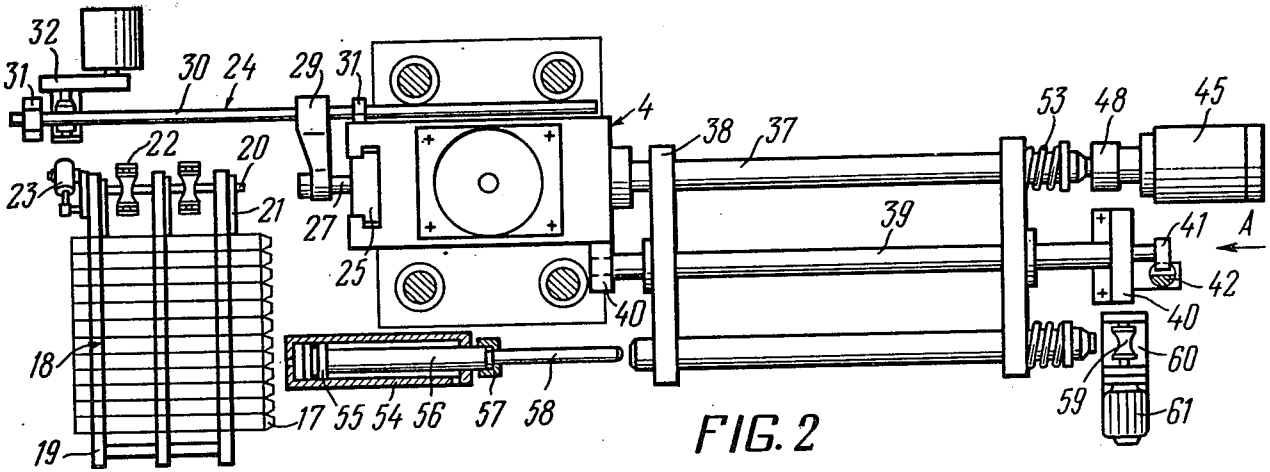
FIG. 2 is a plan view of the apparatus of the present invention.

The bushing 8 serves to accommodate a workpiece blank 17 (FIG. 2). The apparatus is provided with a loader for loading the blanks 17 into the space of the bushing 8. The loader comprises a rack 18 used to hold the blanks 17 and guide beams 19 serving to direct the blanks 17 moving thereon toward the place where they are loaded into the container 4. The ends of the beams 19, located adjacent the loading place receive a shaft 20 which carriers plates 21 attached thereto for holding the successive blank 17 to be loaded when in an axially aligned position in relation to the bushing 8, and for feeding the blank 17 to rollers 22 installed in supports in such a manner that their axes are normal to the axis of the bushing 8. The shaft 20 is geared to a separate drive 23.

The blanks 17 arranged on the rack 18 are preworked before pressing, so that the end of the each blank facing the container 4 is tapered.

The apparatus incorporates a lock 24 which shuts the loading hole in the bushing 8 (FIG. 1) after the next blank 17 (FIG. 2) is loaded. The lock 24 comprises a plate 25 fitted into the tee-shaped groove in the body 7 and movable reciprocally in the vertical direction when driven by a hydraulic drive which is essentially an actuating cylinder 26 (FIG. 1). The plate 25 has a hole wherein a holder 27 is introduced, with a plug 28 seated at the end of the holder facing the bushing 8. To allow fitting of the plug 28 into the hole in the plate 25, the diameter of the hole is somewhat larger than that of the plug 28. The holder 27 is connected to a rod 30 by means of an arm 29 (FIG. 2). The rod 30 seated in supports 31 is reciprocally movable along its axis parallel to the bushing 8. The rod is actuated by a drive 32 to which it is linked mechanically. The length of the rod 30 is about twice that of the blank 17, and the arm 29 carrying the holder 27 with the plug 28 is located in the middle of the rod.

A die 33 is installed in the hole in the bushing 8 (FIG. 1) in such a manner that the right end surfaces (according to the drawing) of the bushing 8 and die 33 lie in the same plane. A section of the hole in the die 33 is tapered to receive the end of the blank 17. The right end face of the die 33 (according to the drawing) is adjacent to the end face of a nut 34 fitted into the threaded portion of the hole in the body 7. The joint between the die 33 and the nut 34 is sealed with a sealing material 35. The stepped hole in the nut 34 accommodates a ring 36 in the central portion, the ring 36 having a hole for the shape of the finished article.

The ring 36 serves for additional pressing of the articles and for sealing the hole in the nut 34 at the section between the die 33 and the ring 36 proper.

The apparatus comprises a receiver of finished articles, made in the form of two mutually parallel horizontal tubes 37 (FIG. 2), the ends of which are linked by arms 38. Holes provided in the center of each arm 38 serve to introduce a shaft 39 seated in the supports 40. Thus, the tubes 37 and the arms 38 form a square framework wherein the shaft 39 constitutes the axis of symmetry. The end of the shaft 39 located at a maximum distance from the body 7 and bushing 8, mounts a gear 41 meshed with a gear bar 42. The bar 42 is integral with a rod 43 (FIG. 3) of an actuating cylinder 44 which turns the framework composed of the tubes 37 (FIG. 2) and arms 38, and sets the tubes 37 in positions sucessively aligned with the hole in the bushing 8 from which a finished article is released in the pressing process.

The article receiver includes another actuating cylinder 45 (FIG. 1) aligned axially with the hole in the bushing 8 and located at a distance from the tube 37. The actuating cylinder 45 comprises a piston 46 and a rod 47, whose free end carries a cover 48 serving to fix the end of the respective tube 37 against the end of the ring 36. The left-hand end of the tube 37 (according to the drawing) enters the hole in the nut 34 at the section whose diameter is maximum, and the right-hand end of the tube 37 is seated in a groove in the cover 48. The joint between the end face of the tube 37 and that of the groove is sealed with a sealing material 49.

A passage also made in the cover 48 permits connection of the internal space of the tube 37 to a hydraulic pressure source 51.

Each tube 37 (FIG. 2) has a free end at the right side (according to the drawing) wherein an annular projection 52 is provided at a certain distance from the respective arm 38. A spring 53 fitted on the tube 37 between the projection 52 and the arm 38 returns the tube 37 to the initial position on completion of the pressing process, and displaces the rod 47 of the actuating cylinder 45.

In addition, the article receiver includes a device for driving the finished articles out of the tube 37. The device comprises an actuating cylinder 54 aligned axially with the tube 37 located at a maximum distance from the container 4. The cylinder 54 incorporates a piston 55 and a rod 56, the end of which receives a rod 58 held by a nut 57. The cross-sectional diameter of rod 58 is somewhat less than the inner diameter of the tube 37.

Rollers 59 installed on the side opposite to the rod 58 are located adjacent the tube 37 and are placed one above the other at a certain distance so that the axes thereof are normal to the axis of the tube 37. The rollers are mounted in supports 60. The shaft of one roller 59 is mechanically linked to the shaft of an electric motor 61 serving to actuate the roller 59, and the article released from the tube 37 due to action of the rod 58 is caught and extracted fully.

The apparatus operates as follows.

In the stage preceding the pressing process, the plunger 14 is in the uppermost position and is fully extended from the bushing 9. The plug 28 is in the retracted left-hand position (according to the drawing) and is located on the left side of the rack 18 carrying the blanks 17. The plate 25 is elevated to the uppermost position. The rod 47 of the cylinder 45 carrying the cover 48 is displaced to the right, and one tube 37 is axially aligned with the bushing 8 at a certain distance from the right-hand end face (according to the drawing) of the nut 34. The rod 56 mounting the rod 58 is displaced to the left so that the rod 58 is fully extracted from the respective tube 37. The plates 21 are set to the plane of the beams 19, and one blank 17 is placed above the plates 21.

For loading the blank 17 into the internal space of the bushing 8, the drive of the shaft 20 is started. The plates 21 attached to the shaft 20 are caused to turn, and the free ends thereof travel upward so that the blank 17 rolls down to the rollers 22. Now the drive 32 is started, so that the rod 30 starts travelling to the right together with the arm 29 installed thereon and carrying the holder 27 with the plug 28. During displacement, the plug 28 drives the blank 17 to the right toward the hole in the bushing 8 and moves until the blank 17 is fully seated in the internal space in bushing 8, and the plug 28 shuts the inlet hole in the bushing. In this state, the tapered end of the blank 17 is introduced into the tapered portion of the hole in the die 33, and shuts the hole. Then the actuating cylinder 26 is switched on and the plate 25 starts moving downwardly until the inlet hole in the bushing 8 is partly overlapped. Thus, the plug 28 is locked in the bushing 8.

Now the spaces in the bushings 8 and 9 are filled with a hydraulic fluid, such as an glycerol and ethylene glycol mixture. The composition of the hydraulic fluid depends on the material of the blank and on the pressure sufficient to deform said material. After the bushings 8 and 9 are filled with fluid, the actuating cylinder 45 is started, the rod 47 thereof along with the cover 48 attached thereon travels to the left, displaces the tube 37 and compresses the spring 53. The rod continues travelling until the left-hand end of the tube 37 is brought into contact with the nut 34 and the end face of the ring 36.

In order to accomplish the pressing process for shaping the blank 17, the plunger 14 is introduced into the vertical chamber in the bushing 9. For introducing the plunger 14, the yoke 3 is displaced downward. As a result, the plunger 14 develops a hydraulic pressure acting on the blank 17 and forcing it through the hole in the die 33. Since the hydraulic pressure is applied to the whole surface area of the blank 17 with the exception of the tapered end thereof introduced into the die 33, an unbalanced force is exerted along the axis of the blank 17, with the result that the blank is squeezed through the hole in the die 33.

After the article is released from the die 33, it is carried through the ring 36 wherein additional squeezing is effected. The reduction ratio depends on the operation to be accomplished during squeezing of the article, e.g., calibration or training of the article, or producing a longitudinal compression stress essential to deformation of materials of low plasticity where defects in the form of cracks are probable if the above requirement is not satisfied.

After the finished article is discharged completely into the tube 37 of the article receiver, the apparatus is prepared for the next pressing cycle. The article is discharged fully into the tube 37 due to the fact that the ring 36 seals the outlet hole in the body 7 at the section between the die 33 and the ring 36. As a result, the hydraulic pressure built up in the bushing 8 continues driving the article even after it is squeezed out of the die 33.

Figure 3:
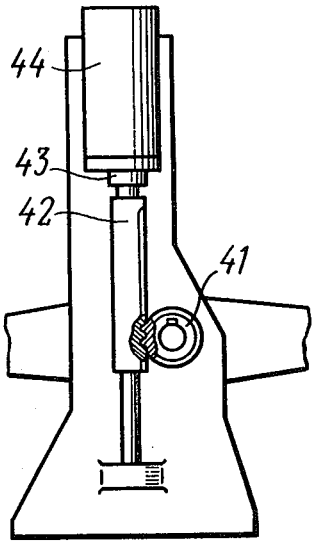
FIG. 3 is a view of the apparatus taken along the arrow A in FIG. 2.

The piston 46 of the actuating cylinder 45 is deflected to the right, so that the rod 47 together with the cover 48 are displaced to the right to free the tube 37 acted upon by the spring 53 and thereby the tube is displaced through the holes in the arms 38 away from the nut 34. At this stage, the framework drive is started to actuate the framework formed by the tubes 37 and arms 38. As a consequence, the rod 43 of the cylinder 44 moves downward (as shown in the drawing of FIG. 3), and displaces the gear bar 42 which turns the gear 41 seated on the shaft 39. Thus, the framework is turned through 180° after the turn is completed, the tube 37 carrying the article is placed in a position axially aligned with the rod 58, and the empty tube 37 is axially aligned with the bushing 8. As the framework is turned to receive the finished article, the inlet hole in the bushing 8 is opened for charging the next blank 17. Then the drive 26 is started to move the plate 25 upward so as to fully open the inlet hole in the bushing 8. Now the holder 27 is assembly with the plug 28 is moved to the full left-hand position by means of the drive 32. Further charging of the next blank 17 into the bushing 8 and the subsequent operations are carried out in the same manner as described above, i.e., the cycle is repeated.

As the plate 25 and the plug 28 are displaced, the article is removed from the tube 37. For this purpose, the actuating cylinder 54 is started, the rod 56 moves to the right, and the rod 58 installed thereon drives the article out of the tube 37. The article enters the nip between the rollers 59, and the drive 61 of one roller is started at the instant when the actuating cylinder 54 is engaged. The rollers 59 grip the article and move it completely out of the tube 37.

After the next article is pressed, the framework comprising the tubes 37 and the arms 38 is turned again so that the tube 37 carrying the article is placed in a position where it is axially aligned with the rod 58.

The proposed apparatus also permits pressing of articles with back pressure applied, whereby the article released from the die 33 is acted upon by a hydraulic pressure on all sides. The pressure applied depends on the material of blank 17 and on the reduction ratio of the die 33 at pressing. This method is intended to manufacture articles of material having a comparatively low plasticity.

The tube 37 of the finished article receiver is first filled with fluid supplied from the hydraulic pressure source 51 through the passage 50 in the cover 48. Filling is accomplished after the tube 37 is fixed against the nut 34 and after the pressure built up in the bushings 8 and 9 is equal to or somewhat inexcess of the back pressure. During the pressing process, the hydraulic pressure inside the tube 37 is maintained constant. On completion of the process, the finished article is removed from the tube 37 in the same manner as in the case described above.

It is thus apparent from the embodiments described herein above that the apparatus for hydraulic pressing of metals constructed according to the present invention shows a high productivity and is simple in maintenance.

We claim:

1. An apparatus for hydraulic pressing of metals, comprising a container; a vertical chamber provided in said container for being filled with hydraulic fluid; a horizontal chamber in said container communicating with said vertical chamber and having inlet and outlet holes axially aligned relative to each other; a plunger slidably arranged in said vertical chamber; lock means for repeatedly closing the inlet hole in said horizontal chamber; loader means for loading workpiece blanks into said horizontal chamber and located adjacent the inlet hole thereof; a die installed in the outlet hole of said horizontal chamber; a receiver means for receiving finished articles from said die, said receiver means being located adjacent the outlet hole in said horizontal chamber and comprising a framework consisting of two mutually parallel horizontal tubes and arms interconnecting the tubes at the ends thereof; a shaft rigidly connected to the arms of said framework and serving as an axis of symmetry of said framework; drive means for said shaft for turning framework in a vertical plane for successive axial alignment of each tube with the outlet hole in said horizontal chamber for discharge of a finished article into said tube during the pressing process, a ring installed in the outlet hole in the horizontal chamber at a location downstream of the die, said ring having a hole with a shape corresponding to that of the finished article for effecting additional shaping of the article and for sealing the outlet hole between the die and the end face of the tube which receives the finished article, a source of hydraulic pressure connected to said receiver means to produce a back pressure during the pressing process, said source communicating with the internal space of the respective tube, said receiver means further comprising an actuating cylinder axially aligned with the horizontal chamber of the container and including a rod with a cover at the end of said rod for sealing the internal space of the tube and for pressing the tube against said ring around said hole therein to effect the sealing between said tube and ring.

2. An apparatus as claimed in claim 1 wherein said receiver means further comprises means for driving the finished article from the tube including a rod axially aligned with said tube and means for reciprocally driving said rod into and out of said tube.

3. An apparatus as claimed in claim 1 wherein each tube is slidable in said arms, a spring acting on each tube to urge the same along its axis under the force exerted by the spring, said spring bearing at one end against an annular projection on said tube, and at the other end against said arm such that said spring returns said tube to an initial position on completion of the pressing process and displaces the rod of said actuating cylinder.

* * * * *